US008491218B2

(12) United States Patent
Halvorson et al.

(10) Patent No.: US 8,491,218 B2
(45) Date of Patent: Jul. 23, 2013

(54) PAVEMENT CRACK ROUTER

(75) Inventors: Michael Stuart Halvorson, Plymouth, MN (US); Stephen R. Johnson, Eagan, MN (US)

(73) Assignee: Cimline, Inc., Minneapolis, MN (US)

( * ) Notice: Subject to any disclaimer, the term of this patent is extended or adjusted under 35 U.S.C. 154(b) by 0 days.

(21) Appl. No.: 13/425,602

(22) Filed: Mar. 21, 2012

(65) Prior Publication Data

US 2012/0243938 A1 Sep. 27, 2012

Related U.S. Application Data

(60) Provisional application No. 61/454,775, filed on Mar. 21, 2011.

(51) Int. Cl.
*E01C 23/09* (2006.01)

(52) U.S. Cl.
USPC ..... 404/87; 404/93; 404/94; 299/39.3

(58) Field of Classification Search
USPC ..... 404/87, 93, 94; 299/39.3
See application file for complete search history.

(56) References Cited

U.S. PATENT DOCUMENTS

| | | | | |
|---|---|---|---|---|
| 3,801,211 | A * | 4/1974 | Perkins | 404/75 |
| 4,634,188 | A * | 1/1987 | Persson | 299/40.1 |
| 4,764,051 | A * | 8/1988 | Whitney | 404/16 |
| 4,889,675 | A * | 12/1989 | Chiuminatta et al. | 264/154 |
| 4,900,094 | A * | 2/1990 | Sergeant | 299/39.6 |
| 5,176,426 | A * | 1/1993 | Adamson | 299/39.3 |
| 5,494,373 | A * | 2/1996 | Amon | 404/74 |
| 7,039,986 | B2 * | 5/2006 | Glenn et al. | 16/430 |
| 7,704,123 | B2 * | 4/2010 | Marsic et al. | 451/8 |
| 2002/0195869 | A1 * | 12/2002 | Dybsetter | 299/39.3 |
| 2007/0194617 | A1 * | 8/2007 | Moller et al. | 299/1.5 |

* cited by examiner

*Primary Examiner* — Raymond W Addie
(74) *Attorney, Agent, or Firm* — Alan Kamrath; Kamrath IP Lawfirm, P.A.

(57) ABSTRACT

A pavement crack router includes a plurality of bits rotatably mounted to a frame in a direction. A ratchet gear is rotatable with a wheel mounted to the frame. A movable safety release is operably connected to a ratchet rod pivotable between an engaging position engaged with the ratchet gear preventing rotation of the wheel in a reverse direction and a releasing position disengaged from the ratchet gear allowing free rotation of the wheel. An elastomeric inner tube is mounted around a lower end of each of two handle bars and is slideably received in an outer tube fixed to the frame. Two elastomeric washers are mounted around the lower end of each handle bar and sandwich the inner tube within the outer tube. A switch is operable to lower the frame and bits for opening and cleaning a crack in pavement.

20 Claims, 6 Drawing Sheets

PAVEMENT CRACK ROUTER

BACKGROUND

A pavement crack router for opening and cleaning cracks in pavement is shown.

Pavement crack routers include a plurality of bits to open and clean cracks in pavement to be filled with a sealant. The operator of a pavement crack router has to constantly raise and lower the plurality of bits of the pavement crack router getting in and out of random cracks in the pavement. When the bits hit virgin pavement, the bits have a tendency to catch the pavement and surge backward towards the operator. In an approach to prevent the pavement crack router from kicking back, an electric clutch is provided on a drive shaft that drives the bits, and a switch on the handlebar can be pressed to disengage the electric clutch from a cutting drum that drives the bits. In another approach using a paddle brake system, the operator has to push down on the handle to engage the paddle brake system. Operations in both approaches are not convenient to the operator. Furthermore, a considerable amount of vibration is transmitted back to the operator during operation, since the pavement crack routers rotate two drums of considerable weight at high speeds.

Thus, a need exists for a pavement crack router capable of easily preventing kicking back, decreasing vibration, and allowing easy operation during repeated raising and lowering of the plurality of bits of the pavement crack router.

BRIEF SUMMARY

This need and other problems in the field of easy and safe operation of pavement crack routers are solved by providing, in a first aspect, a pavement crack router including a plurality of bits rotatably mounted to a frame about a cutting axis in a clockwise direction and circumferentially spaced about the cutting axis. The plurality of bits is adapted to be driven by a drive for opening and cleaning a crack in pavement. A wheel is mounted to the frame about a wheel axis parallel to the cutting axis. The wheel rests on and is movable along the pavement to movably support the frame upon the pavement. A ratchet gear is rotatable with the wheel about the wheel axis. Rotation of the wheel and the ratchet gear is independent of the drive of the plurality of bits. A ratchet rod is pivotable about a pivot axis spaced from the cutting axis and the wheel axis. The ratchet rod is operatively connected to a safety release in which movement of the safety release causes pivotal movement of the ratchet rod between an engaging position and a releasing position. An outer end of the ratchet rod is engaged with the ratchet gear when the ratchet rod is in the engaging position preventing rotation of the wheel in a counterclockwise direction but allowing rotation of the wheel in the clockwise direction, avoiding injury to an operator by avoiding kickback of the pavement crack router. The outer end of the ratchet rod is disengaged from the ratchet gear allowing rotation of the wheel in either of the clockwise and counterclockwise directions when the ratchet rod is in the releasing position. The outer end of the ratchet rod is radially spaced greater from the ratchet gear in the releasing position than in the engaging position.

In a second aspect, a pavement crack router includes a frame movably supported upon pavement. A plurality of bits is rotatably supported by the frame about a cutting axis and circumferentially spaced about the cutting axis. The plurality of bits is adapted for opening and cleaning a crack in the pavement. A lower end of each of two handle bars is slideably received in one of two inner tubes made of an elastomeric material. An outer tube is mounted around each inner tube and fixed to one of two frame plates mounted to the frame. Two washers made of an elastomeric material are mounted around the lower end of each handle bar and sandwiches one of the inner tubes within one of the outer tubes, with an upper end of each handle bar having a spacing to the frame larger than a spacing of the lower end of each handle bar to the frame. Each inner tube is deformable between one of the handle bars and one of the outer tubes. The washers allow movement of the handle bars relative to the outer tubes and the frame plates. The vibration of the pavement crack router will not be transmitted to the operator or at least will be significantly reduced.

In a third aspect, a pavement crack router includes a plurality of bits rotatably supported by a frame about a cutting axis and circumferentially spaced about the cutting axis. The plurality of bits is adapted for opening and cleaning a crack in pavement. A frame axle is fixed generally perpendicular to and between two beams and spaced from the cutting axis in a length direction. Two wheels are spaced in a width direction perpendicular to the frame axle and rotatable about a wheel axis generally perpendicular to the beams. The wheels rest on and are movable along the pavement to movably support the frame upon the pavement. A rear end of a lever is fixed to the frame axle, with the frame axle located intermediate a front end of the lever and the wheel axis. A shaft is coupled to the front end of the lever and drivable by a motor supported by the frame. A potentiometer is electrically connected to the motor and adjustable to control an amount of rotation of the motor. A switch is electrically connected to the motor to control movement of the frame axle. When the switch is in the first position, the frame axle, the beams, and the wheels pivot in the first direction with the frame moving towards the pavement in a vertical direction perpendicular to the length direction and the wheel axis and with the plurality of bits moving towards the pavement and entering the crack in the pavement to a cutting depth. The frame traveling in the vertical direction and the cutting depth of the plurality of bits correspond to the amount of rotation of the motor. When the switch is in the second position, the frame axle, the beams, and the wheels pivot in the second direction with the frame and the plurality of bits moving away from the pavement in the vertical direction.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
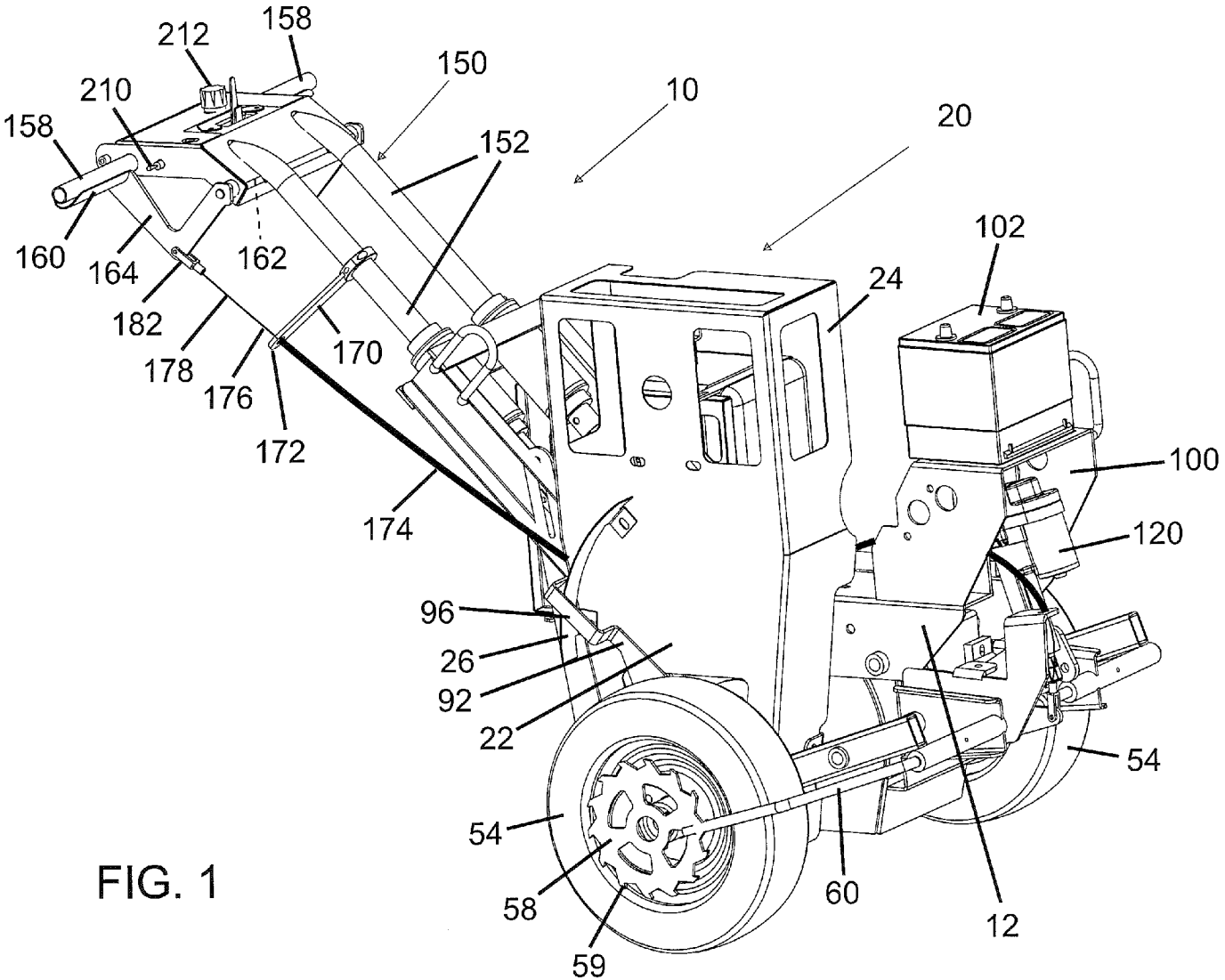
FIG. 1 shows a perspective view of a pavement crack router, with parts removed for ease of illustration.
Figure 2:
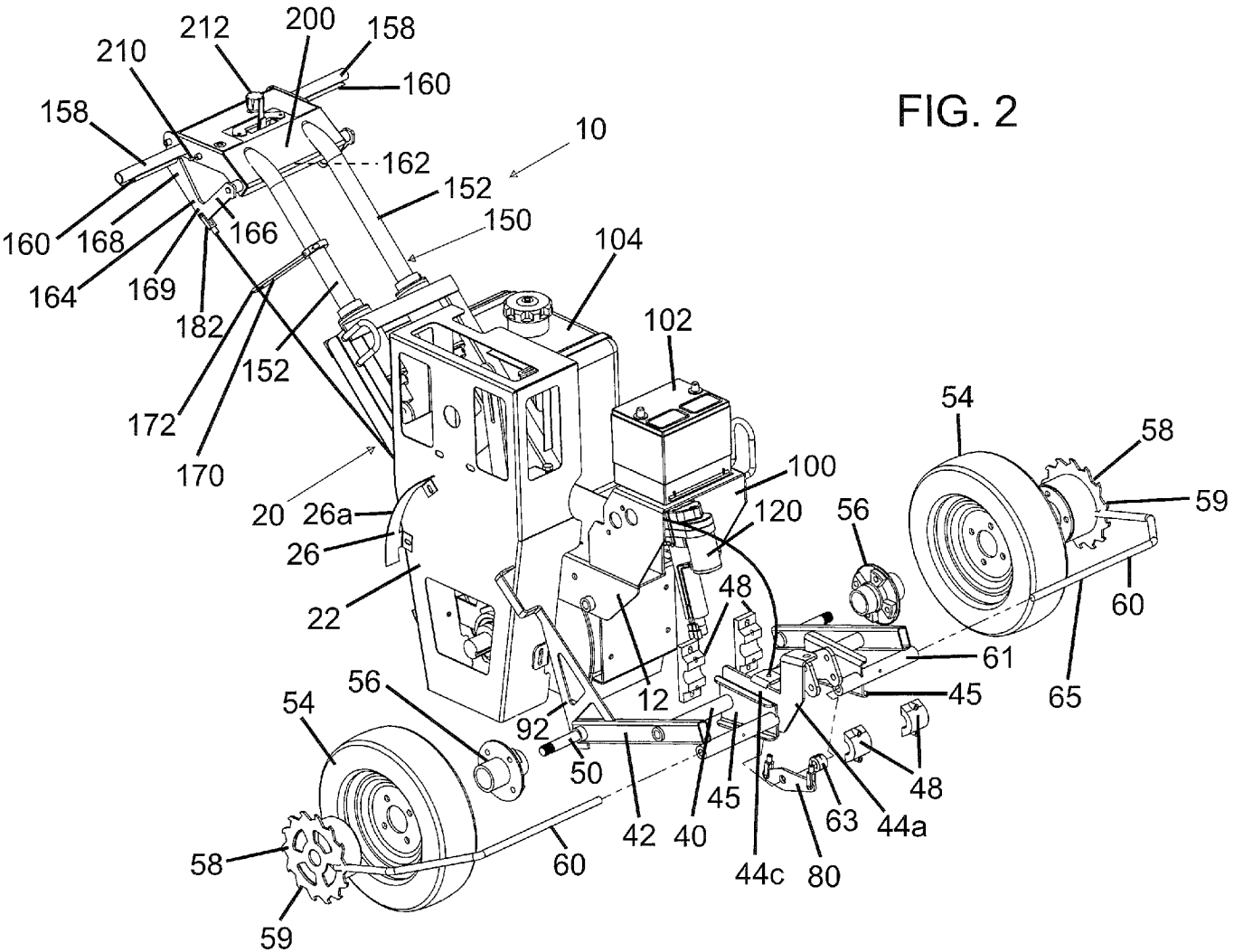
FIG. 2 shows an exploded, perspective view of the pavement crack router of FIG. 1, with parts removed for ease of illustration.
Figure 3:
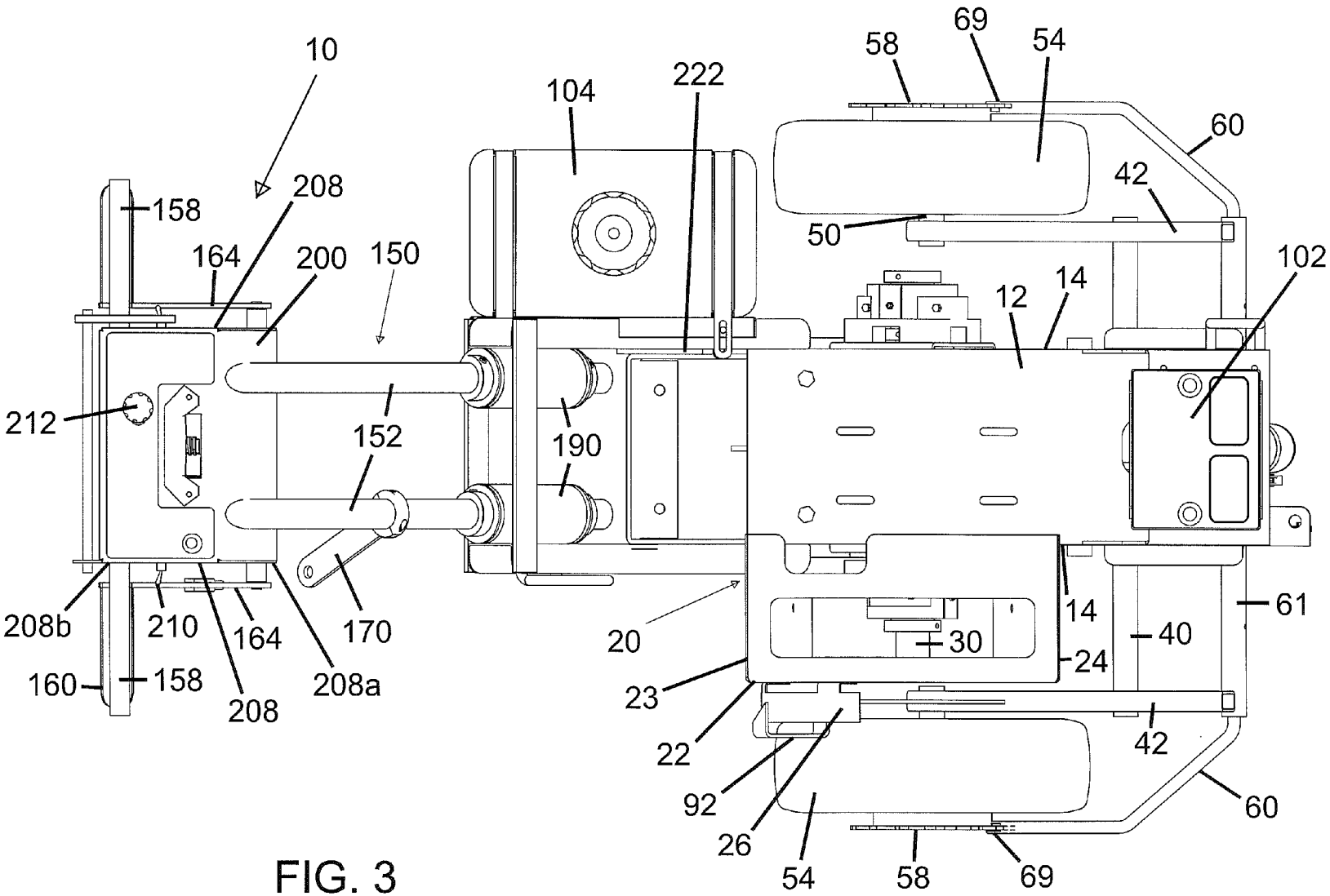
FIG. 3 shows a top view of the pavement crack router of FIG. 1, with parts removed for ease of illustration.
Figure 4:
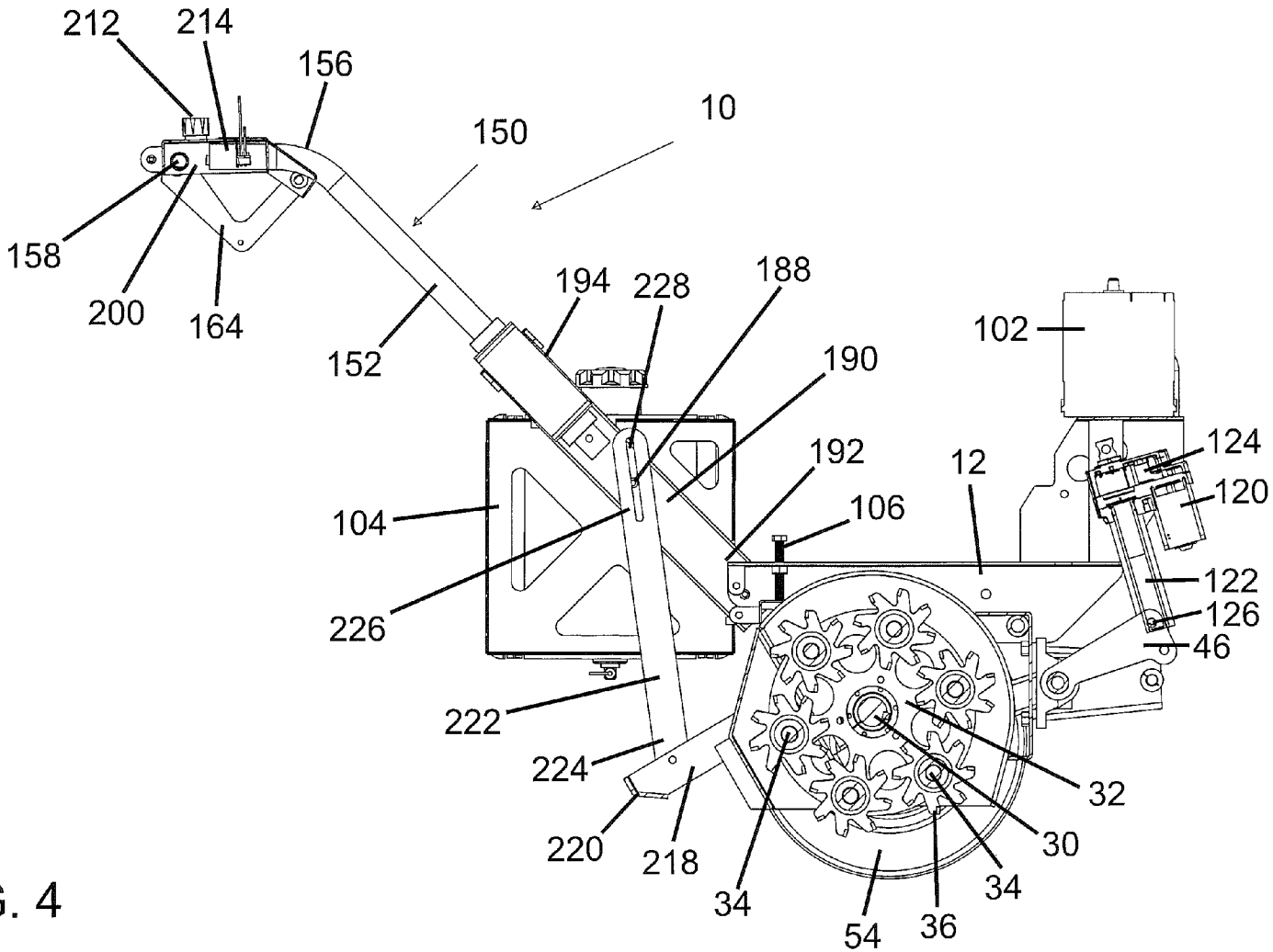
FIG. 4 shows a cross sectional view of the pavement crack router of FIG. 1, with parts removed for ease of illustration.
Figure 5:
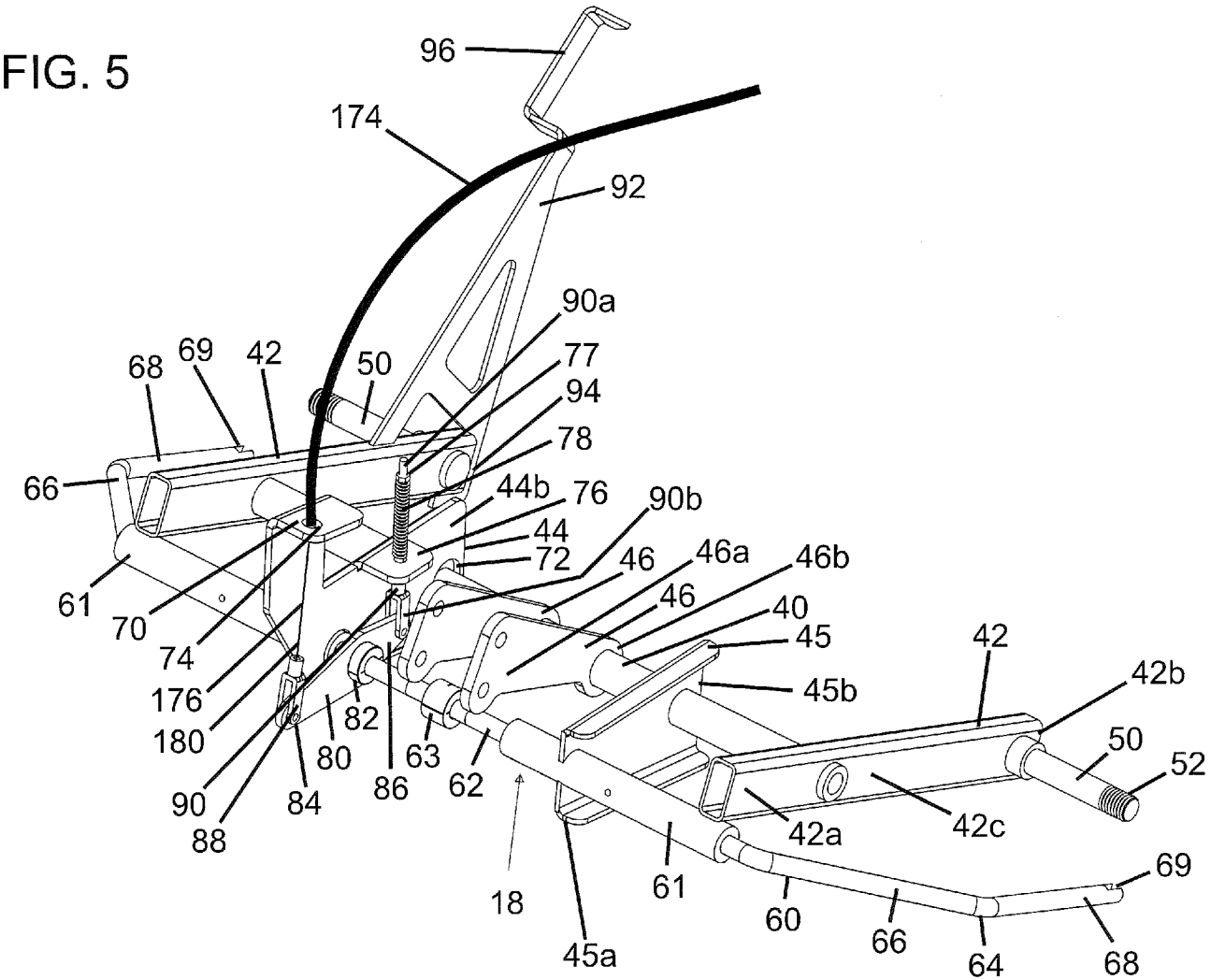
FIG. 5 shows a perspective view of an anti kickback device of the pavement crack router of FIG. 1.
Figure 6:
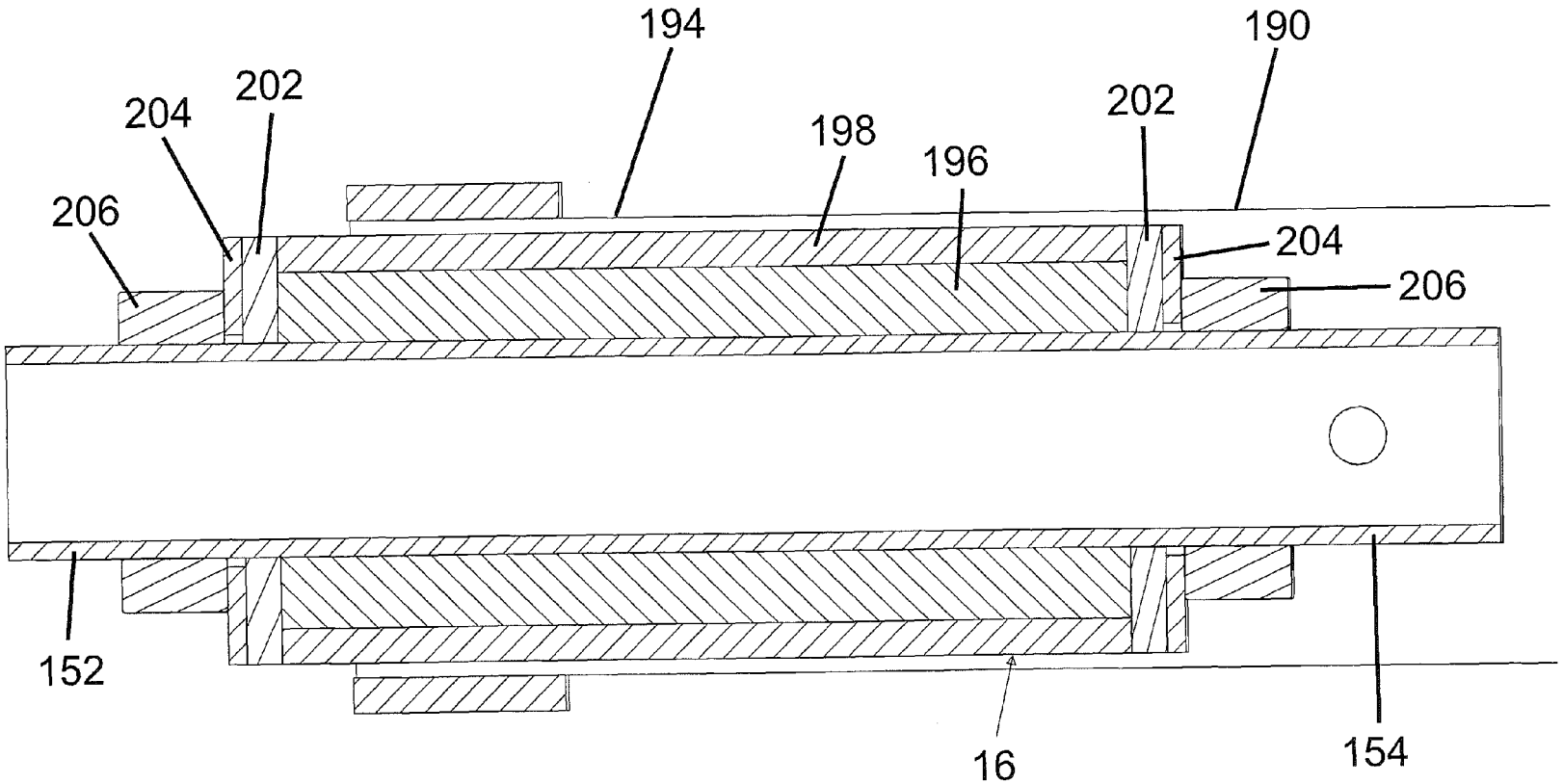
FIG. 6 shows a cross sectional view of a vibration damping device of the pavement crack router of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "lower", "upper", "front", "rear", "back", "inner", "outer", "right", "horizontal", "end", "portion", "section", "outward", "upward", "downward", "forward", "rearward", "length", "depth", "width", and similar terms are used herein, it should be understood that these terms have reference only to the structure shown in the drawings as it would appear to a person viewing the drawings and are utilized only to facilitate describing the illustrative embodiments.

DETAILED DESCRIPTION

A pavement crack router is shown in the drawings and generally designated 10. According to the form shown, pavement crack router 10 includes a frame 12 having first and second sides 14 spaced in a width direction. A shroud 20 is mounted to first side 14 of frame 12 and includes a sidewall 22, a back wall 23, and a front wall 24 spaced from back wall 23 in a length direction perpendicular to the width direction. Each of back and front walls 23 and 24 has left and right ends spaced in the width direction, with sidewall 22 extending between the right ends of back and front walls 23 and 24. A depth indicator 26 is mounted to sidewall 22 and includes a scale on a surface 26*a* thereof facing away from front wall 24.

In the form shown, pavement crack router 10 includes a cutter assembly 25 having a cutting drum shaft 30 rotatably supported between first and second sides 14 of frame 12, with the cutting drum shaft 30 defining a cutting axis perpendicular to the length direction. Cutter assembly 25 further includes first and second cutting drums 32 mounted axially spaced on cutting drum shaft 30. A plurality of bit shafts 34 extends between first and second cutting drums 32. A star-shaped bit 36 is mounted on each bit shaft 34 and rotates relative to first and second cutting drums 32. Bits 36 are rotatable in a direction, such as a clockwise direction, about the cutting axis and circumferentially spaced about the cutting axis. However, other forms of cutting drums 32 and bits 36 can be used.

In the form shown, a frame axle 40 is mounted in front of cutting drum shaft 30 by mounting brackets 48. Frame axle 40 is spaced from cutting drum shaft 30 in the length direction and generally extends parallel to the width direction. Frame axle 40 is pivotable in a first direction or a second direction opposite to the first direction. First and second beams 42 are fixed generally perpendicular to frame axle 40. In the form shown, each of first and second beams 42 includes front and rear ends 42*a* and 42*b* spaced in the length direction and an intermediate portion 42*c* between front and rear ends 42*a* and 42*b*. Two ends of frame axle 40 are fixed to intermediate portions 42*c* of first and second beams 42. Two brackets 45 are provided, with each including front and rear ends 45*a* and 45*b* spaced in the length direction. Rear ends 45*b* of brackets 45 are fixed on frame axle 40. Another bracket 44 is provided and includes front and rear ends 44*a* and 44*b* spaced in the length direction and an intermediate portion 44*c* between front and rear ends 44*a* and 44*b*. A hole 72 is formed in rear end 44*b* of bracket 44 and pivotably receives frame axle 40. A bend 70 extends from an upper edge of front end 44*a* of bracket 44 and includes a cable hole 74. A spring board 76 extends horizontally from intermediate portion 44*c* of bracket 44.

In the form shown, two levers 46 are mounted on frame axle 40 and located intermediate brackets 45. Each lever 46 includes front and rear ends 46*a* and 46*b* spaced in the length direction, with rear ends 46*b* of levers 46 fixed on frame axle 40. A wheel axle 50 is mounted to rear end 42*b* of each of first and second beams 42 and extends in the width direction. Each wheel axle 50 has an outer end 52 with an outer threading in the form shown. A wheel 54 is mounted around each wheel axle 50 through a hub 56 coaxially mounted around wheel axle 50. Thus, wheels 54 are rotatable about a wheel axis defined by wheel axles 50, with the wheel axis being generally perpendicular to the length direction and first and second beams 42 and parallel to the cutting axis and frame axle 40. A ratchet gear 58 is mounted to outer end 52 of each wheel axle 50. Thus, each wheel 54 is located intermediate one of ratchet gears 58 and one of first and second beams 42, with each ratchet gear 58 fixed to and rotatable with one of wheels 54 about the wheel axis. Each ratchet gear 58 includes a plurality of teeth 59 on an outer periphery thereof.

In the form shown, pavement crack router 10 includes an anti kickback device 18 including a ratchet rod 65 having two arms 60. A jacket 61 is fixed, such as by welding, to front end 45*a* of each bracket 45 and holds one of arms 60. Front end 44*a* of bracket 44 is fixed to one of jackets 61. Each arm 60 includes an inner end 62 pivotably extending through one of jackets 61. Inner ends 62 of arms 60 are coaxially coupled together by a coupler 63. Each arm 60 further includes an outer end 64 having a first section 66 extending outward and rearward from inner end 62 and a second section 68 extending rearward from first section 66. Each second section 68 includes a catch 69 in the form of a notch in a distal end thereof. Front end 42*a* of each of first and second beams 42 is fixed to a corresponding jacket 61 such as by welding. Ratchet rod 65 is pivotable about a pivot axis spaced from the cutting axis and the wheel axis, with frame axle 40 located intermediate the pivot axis and the wheel axis. Specifically, ratchet rod 65 is pivotable between an engaging position in which catch 69 on outer end 64 of each arm 60 is engaged with one of ratchet gears 58 to prevent rotation of wheels 54 in a counterclockwise direction but allow rotation of wheels 54 in the clockwise direction and a releasing position in which catch 69 on outer end 64 of each arm 60 is disengaged from ratchet gear 58 allowing rotation of wheels 54 in either of the clockwise and counterclockwise directions. Namely, wheels 54 can move in either of a forward direction and a rearward direction when ratchet rod 65 is in the releasing position.

In the form shown, a rocker 80 includes first and second ends 84 and 86 spaced in the length direction and an intermediate portion 82 between first and second ends 84 and 86. Intermediate portion 82 of rocker 80 is mounted to inner end 62 of one of arms 60. A cable anchor 88 includes upper and lower ends spaced in a vertical direction perpendicular to the length and width directions and the wheel axis. The lower end of cable anchor 88 is pivotably mounted to first end 84 of rocker 80. A spring holder 90, in the form shown as a rod, has upper and lower ends 90*a* and 90*b* spaced in the vertical direction. A stop 77 is formed on upper end 90*a* of spring holder 90. Lower end 90*b* of spring holder 90 is pivotably mounted to second end 86 of rocker 80 and extends through spring board 76. A spring 78 is mounted around spring holder 90 and between spring board 76 and stop 77 on upper end 90*a* of spring holder 90. Spring 78 biases ratchet rod 65 to the engaging position.

In the form shown, a pointer 92 includes lower and upper ends 94 and 96 spaced in the vertical direction. Lower end 94 of pointer 92 is fixed to rear end 42*b* of first beam 42. Upper end 96 of pointer 92 is pivotable relative to depth indicator 26. A depth of a crack in pavement can be indicated by pointer 92 on the scale of depth indicator 26.

In the form shown, a tightener 106 is mounted to frame 12 and operably connected to cutter assembly 25. A drive, such as an engine, can be mounted on frame 12, and an output shaft of the engine can be coupled to cutting drum shaft 30 such as by pulleys and belts. Tightener 106 can be rotated to move cutter assembly 25 including cutting drum shaft 30 relative to the output shaft of the engine for adjusting the tightness of the belts. However, the output shaft of the engine can be coupled to cutting drum shaft 30 by other suitable provisions, such as gears and chains. A fuel tank 104 is mounted on second side 14 of frame 12 to supply the engine with fuel. A seat 100 is mounted to frame 12 and located above frame axle 40 and in front of front wall 24 of shroud 20. A battery 102 is mounted on seat 100.

In the form shown, a driving member 110 is connected to frame axle 40 to drive frame axle 40 to pivot in the first and second directions. Driving member 110 includes an actuator 120, such as a linear actuator, mounted to seat 100. Driving member 110 further includes a shaft 122 and a motor 124 supported by frame 12 for driving shaft 122 to rotate. Battery 102 provides power to motor 124. Shaft 122 includes a coupler 126 coupled to front ends 46*a* of levers 46. Thus, when motor 124 is activated, shaft 122 is driven to push or pull levers 46 via transmission of coupler 126. Frame axle 40 and brackets 45, first and second beams 42, and wheel axles 50 mounted on frame axle 40 are, thus, pivoted in mounting brackets 48 in either of the first and second directions.

In the form shown, a handle assembly 150 is mounted to a rear side of frame 12 and includes two frame plates 190 each in the form shown as a hollow cylinder having a lower end 192, an upper end 194 spaced from lower end 192 in the vertical direction, and an intermediate portion between lower and upper ends 192 and 194. Lower end 192 of each frame plate 190 is fixed to frame 12. A bolt 188 is mounted to the intermediate portion of each frame plate 190. Handle assembly 150 further includes two handle bars 152 each having lower and upper ends 154 and 156, with upper end 156 having a spacing to frame 12 larger than a spacing of lower end 154 to frame 12, with lower end 154 of each handle bar 152 slideable relative to a corresponding frame plate 190. A vibration damping device 16 is provided between each frame plate 190 and one of handle bars 152. Specifically, each vibration damping device 16 includes an inner tube 196 mounted around and slideably receiving lower end 154 of handle bar 152. Inner tube 196 is made of an elastomeric material, such as rubber. An outer tube 198 made of a rigid material, such as steel, is mounted around inner tube 196 and is fixed to a corresponding frame plate 190 such as by welding. Two washers 202 made of an elastomeric material, such as rubber, are mounted around lower end 154 of handle bar 152 and sandwich inner tube 196 within outer tube 198. Washers 202 are fixed in place by two set collars 206 and two steel washers 204 each located intermediate one of set collars 206 and one of washers 202. Other arrangements for fixing washers 202 can be used. Each inner tube 196 is deformable between one of handle bars 152 and one of outer tubes 198. Washers 202 allow movement of handle bars 152 relative to outer tubes 198 and frame plates 190. Thus, vibration damping devices 16 provide pavement crack router 10 with a vibration damping effect.

In the form shown, a console 200 is mounted to upper ends 156 of handle bars 152. Console 200 includes two lateral sides 208 spaced in the width direction, with each lateral side 208 having front and rear ends 208*a* and 208*b* spaced in the length direction. A handle grip 158 extends outward in the width direction from rear end 208*b* of each lateral side 208 of console 200. A pin 162 is extended through front ends 208*a* of lateral sides 208 of console 200. Two cranks 164 are provided, with each having a first arm 166 connected to an end of pin 162, a second arm 168 extending rearward from first arm 166, and an intermediate portion 169 between first and second arms 166 and 168. Second arm 168 of each crank 164 includes a safety release 160 extending parallel to and normally spaced from one of handle grips 158. Upon pivotal movement of cranks 164, safety releases 160 are synchronously movable between first and second positions. Each safety release 160 in the second position has a spacing to one of handle grips 158 smaller than in the first position.

A cable guide 170 includes an end mounted to one of handle bars 152. The other end of cable guide 170 includes a hole 172. A cable jacket 174 is mounted between the other end of cable guide 170 and bend 70 of bracket 44. A cable 176 is extended through cable jacket 174 and has an upper end 178 extending through hole 172 and attached to intermediate portion 169 of one of cranks 164 via a cable anchor 182. A lower end 180 of cable 176 is extended through cable hole 74 of bend 70 and attached to the upper end of cable anchor 88 on rocker 80. By such an arrangement, movement of safety releases 160 between the first and second positions cause pivotal movement of ratchet rod 65 between the engaging position and the releasing position, with ratchet rod 65 being in the engaging position when safety releases 160 are in the first position, with ratchet rod 65 being in the releasing position when safety releases 160 are in the second position. It can be appreciated that pavement crack router 10 can include other provisions for controlling arms 60.

In the form shown, a switch 210, such as a toggle switch, is mounted to one of lateral sides 208 of console 200. Switch 210 is electrically connected to motor 124 of driving member 110. Switch 210 can be moved between third and fourth positions to turn on motor 124 to rotate in either of two opposite directions. A potentiometer 212 is mounted on an upper surface of console 200 and electrically connected to a controller 214 mounted in console 200. Controller 214 is electrically connected to motor 124. Through controller 214, potentiometer 212 can be operated to control an amount of rotation of motor 124, which, in turn, controls the cutting depth of bits 36.

In the form shown, pavement crack router 10 further includes a skid plate 218 having an upper end fixed to frame 12 and a lower end 220. Two braces 222 are provided, with each including a lower end 224 pivotably connected to lower end 220 of skid plate 218 and an upper end 226 pivotably connected to a corresponding frame plate 190. Upper end 226 of each brace 222 has an elongated slot 228 slideably receiving bolt 188 on a corresponding frame plate 190. This allows adjustment in an inclined angle of frame plates 190 and handle bars 152. When an operator is not moving pavement crack router 10, lower end 220 of skid plate 218 can rest on the pavement or ground to provide support, with handle bars 152 on a side of skid plate 218 and with cutter assembly 25 on the other side.

Now that the basic construction of pavement crack router 10 has been explained, the operation and some of the advantages of pavement crack router 10 can be set forth and appreciated. In particular, for the sake of explanation, it will be assumed that the engine is turned on, and the operator grips handle grips 158 and safety releases 160. Namely, safety releases 160 are moved to the second position adjacent to handle grips 158. Cable 176 is moved upward and, thus, causes upward pivotal movement of first end 84 of rocker 80 and downward pivotal movement of second end 86 of rocker 80. Spring 78 is compressed. Arms 60 are pivoted in a direction causing downward movement of catches 69 to the releasing position. Thus, catches 69 are disengaged from teeth 59 of ratchet gears 58, allowing movement of wheels 54 in either of the forward direction and the rearward direction.

The operator moves pavement crack router 10 on pavement and guides bits 36 to random cracks in the pavement. Safety releases 160 are released to release cable 176. Rocker 80 pivots in the reverse direction under the action of spring 78. Arms 60 pivot in the upward direction to the engaging position to engage catches 69 with teeth 59 of ratchet gears 58 fixed on wheel axles 50. Thus, movement of wheels 54 in the rearward direction is avoided by preventing wheels 54 from rotating in the counterclockwise direction, preventing injury to the operator by avoiding kickback.

When bits 36 reach a crack in the pavement, the operator moves switch 210 to the third position, causing motor 124 to rotate in a direction moving shaft 122 to push levers 46 via transmission of coupler 126. Frame axle 40, brackets 45, first and second beams 42, wheel axles 50, jackets 61, ratchet gears 58, and wheels 54 are, thus, pivoted in the first direction. Frame 12 moves towards the pavement in the vertical direction. Bits 36 move towards the pavement and enter the crack in the pavement to the cutting depth. Thus, bits 36 are lowered and come in contact with the crack and rotate in the clockwise direction to perform opening and cleaning of the crack for subsequent filling by a sealant. Frame 12 traveling in the vertical direction and the cutting depth of bits 36 correspond to an amount of rotation of shaft 122, which is controlled by the amount of rotation of motor 124. When bits 36 arrive at an end of the crack, the operator moves switch 210 to the fourth position causing rotation of motor 124 in the reverse direction. Coupler 126 is moved by shaft 122 to its initial position. Frame axle 40, brackets 45, first and second beams 42, wheel axles 50, jackets 61, ratchet gears 58, and wheels 54 pivot in the second direction. Frame 12 and bits 36 are moved away from the pavement in the vertical direction. Thus, bits 36 are lifted above the pavement to their original position. Then, the operator can move to the next crack in the pavement. Nevertheless, as mentioned above, potentiometer 212 can be operated to control the cutting depth of bits 36 through controller 214 that controls the amount of rotation of motor 124 to provide a constant cutting depth. The cutting depth is indicated by pointer 92 and the scale on depth indicator 26. Operation of pavement crack router 10 is easy during repeated raising and lowering of pavement crack router 10 by simply moving switch 210. It is appreciated that rotation of wheels 54 and ratchet gears 58 is independent of the drive of bits 36.

Due to provision of vibration damping devices 16 including inner tubes 196 and washers 202 made of elastomeric materials, the vibration of pavement crack router 10 will not be transmitted to the operator or at least will be significantly reduced.

In the event that kickback while cutting occurs, since safety release 160 is normally in the first position under the bias of spring 78, movement of wheels 54 in the rearward direction is avoided by preventing wheels 54 from rotating in the counterclockwise direction, preventing injury to the operator by avoiding kickback.

Now that the basic teachings have been explained, many extensions and variations will be obvious to one having ordinary skill in the art. For example, although anti kickback device 18, vibration damping devices 16, and bits 36 with adjustable constant cutting depth have been utilized in a single pavement crack router 10 and are believed to produce synergistic results, only one or two of anti kickback device 18, vibration damping devices 16, and bits 36 with adjustable constant cutting depth could be provided in pavement crack router 10. As an example, pavement crack router 10 including only anti kickback device 18 does not have to include frame axle 40 and corresponding members for providing the constant cutting depth of bits 36. Instead, wheels 54 can be directly mounted to frame 12, and vibration damping devices 16 or of other types and forms can be used if desired.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A pavement crack router comprising, in combination:

a frame;

a plurality of bits rotatably mounted to the frame about a cutting axis in a clockwise direction and circumferentially spaced about the cutting axis, with the plurality of bits adapted to be driven by a drive for opening and cleaning a crack in pavement;

a wheel mounted to the frame about a wheel axis parallel to the cutting axis, with the wheel rested on and movable along the pavement, with the wheel movably supporting the frame upon the pavement;

a ratchet gear rotatable with the wheel about the wheel axis, with rotation of the wheel and the ratchet gear being independent of the drive of the plurality of bits;

a ratchet rod pivotable about a pivot axis spaced from the cutting axis and the wheel axis, with the ratchet rod pivotable between an engaging position and a releasing position, with an outer end of the ratchet rod engaged with the ratchet gear when the ratchet rod is in the engaging position preventing rotation of the wheel in a counterclockwise direction but allowing rotation of the wheel in the clockwise direction, with the outer end of the ratchet rod disengaged from the ratchet gear allowing rotation of the wheel in either of the clockwise and counterclockwise directions when the ratchet rod is in the releasing position, with the outer end of the ratchet rod being radially spaced greater from the ratchet gear in the releasing position than in the engaging position; and a safety release movable between a first position and a second position, with the ratchet rod operatively connected to the safety release, with movement of the safety release between the first and second positions causing pivotal movement of the ratchet rod between the engaging position and the releasing position, with the ratchet rod being in the engaging position when the safety release is in the first position, with the ratchet rod being in the releasing position when the safety release is in the second position.

2. The pavement crack router as claimed in claim 1, further comprising, in combination:

a frame axle spaced from the cutting axis in a length direction perpendicular to the wheel axis;

a first beam including an end fixed generally perpendicular to the frame axle, with the wheel axis being generally perpendicular to the first beam;

a driving member connected to the frame axle, with the driving member selectively driving the frame axle to pivot in one of a first direction and a second direction opposite to the first direction; and a switch electrically connected to the driving member, with the switch movable between third and fourth positions to control movement of the frame axle in one of the first and second directions, with the switch in the third position, the frame axle, the first beam, the ratchet gear, and the wheel pivot in the first direction with the frame moving towards the pavement in a vertical direction perpendicular to the length direction and the wheel axis and with the plurality of bits moving towards the pavement and entering the crack in the pavement to a cutting depth, with the switch in the fourth position, the frame axle, the first beam, the ratchet gear, and the wheel pivot in the second direction with the frame and the plurality of bits moving away from the pavement in the vertical direction.

3. The pavement crack router as claimed in claim 2, further comprising, in combination:

a lever including a rear end fixed to the frame axle and a front end, with the driving member including a motor supported by the frame, with a shaft coupled to the front end of the lever and drivable by the motor, with the motor being operable by the switch to drive the frame axle to pivot in the first and second directions via transmission of the shaft, with a potentiometer electrically connected to the motor and adjustable to control an amount of rotation of the motor, wherein the frame traveling in the vertical direction and the cutting depth of the plurality of bits correspond to the amount of rotation of the motor.

4. The pavement crack router as claimed in claim 3, further comprising, in combination:

a jacket fixed to the frame axle, with the ratchet rod pivotably received in the jacket;

a rocker including first and second ends and an intermediate portion between the first and second ends of the rocker, with the intermediate portion of the rocker mounted to the ratchet rod;

a cable including a lower end attached to the first end of the rocker and an upper end coupled to the safety release; and a spring attached to the second end of the rocker, with the spring biasing the ratchet rod to the engaging position.

5. The pavement crack router as claimed in claim 4, further comprising, in combination:

a spring holder including a lower end pivotably mounted to the second end of the rocker and an upper end, with a stop formed on the upper end of the spring holder; and a bracket fixed to the jacket and pivotably receiving the frame axle, with a spring board extending from the bracket, with the spring mounted around the spring holder and between the spring board and the stop.

6. The pavement crack router as claimed in claim 4, further comprising, in combination:

a console fixed in relation to the frame;

a handle grip fixed to the console; and a crank including first and second arms, with the first arm pivotably mounted to the console, with the safety release fixed to the second arm of the crank, with the crank and the safety release jointly pivotable between the first and second positions, with the safety release in the second position having a spacing to the handle grip smaller than when in the first position.

7. The pavement crack router as claimed in claim 6, further comprising, in combination:

a second beam including an end fixed generally perpendicular to the frame axle, with the wheel axis being generally perpendicular to the second beam;

another wheel rotatable about the wheel axis and spaced from the wheel in a width direction perpendicular to the length direction, with the frame axle located intermediate the pivot axis and the wheel axis, with the other wheel rested on and movable along the pavement, with the other wheel movably supporting the frame upon the pavement; and another ratchet gear rotatable with the other wheel, with the ratchet rod in the engaging position engaged with the other ratchet gear, with the ratchet rod in the releasing position disengaged from the other ratchet gear.

8. The pavement crack router as claimed in claim 7, further comprising, in combination:

another jacket fixed to the frame axle, with the other jacket aligned with the jacket in the width direction, with the ratchet rod including two arms pivotably received in the jacket and the other jacket, respectively, with each of the two arms having an inner end coaxially coupled together, with each of the two arms further having the outer end releasably engaged with one of the ratchet gear and the other ratchet gear, with the first beam fixed to the jacket, with the second beam fixed to the other jacket.

9. The pavement crack router as claimed in claim 6, further comprising, in combination:

two frame plates fixed to the frame;

first and second handle bars each having a lower end and an upper end;

two inner tubes made of an elastomeric material, with each of the two inner tubes slideably receiving the lower end of one of the first and second handle bars;

two outer tubes, with each of the two outer tubes mounted around one of the inner tubes and fixed to one of the two frame plates; and first and second washers mounted around the lower end of each of the first and second handle bars and sandwiching one of the two inner tubes within one of the two outer tubes, with the upper end of each of the first and second handle bars having a spacing to the frame larger than a spacing of the lower end of each of the first and second handle bars to the frame, with the first and second washers made of an elastomeric material, with each of the two inner tubes being deformable between one of the first and second handle bars and one of the two outer tubes, with the first and second washers allowing movement of the first and second handle bars relative to the two outer tubes and the two frame plates.

10. A pavement crack router comprising, in combination:

a frame movably supported upon pavement;

a plurality of bits rotatably supported by the frame about a cutting axis and circumferentially spaced about the cutting axis, with the plurality of bits adapted for opening and cleaning a crack in the pavement;

two frame plates fixed to the frame;

first and second handle bars each having a lower end and an upper end;

two inner tubes made of an elastomeric material, with each of the two inner tubes slideably receiving the lower end of one of the first and second handle bars;

two outer tubes, with each of the two outer tubes mounted around one of the inner tubes and fixed to one of the two frame plates; and first and second washers mounted around the lower end of each of the first and second handle bars and sandwiching one of the two inner tubes within one of the two outer tubes, with the upper end of each of the first and second handle bars having a spacing to the frame larger than a spacing of the lower end of each of the first and second handle bars to the frame, with the first and second washers made of an elastomeric material, with each of the two inner tubes being deformable between one of the first and second handle bars and one of the two outer tubes, with the first and second washers allowing movement of the first and second handle bars relative to the two outer tubes and the two frame plates.

11. The pavement crack router as claimed in claim 10, further comprising, in combination:

a wheel mounted to the frame about a wheel axis parallel to the cutting axis, with the plurality of bits adapted to be driven by a drive to rotate in a clockwise direction, with the wheel rested on and movable along the pavement, with the wheel movably supporting the frame upon the pavement;

a ratchet gear rotatable with the wheel about the wheel axis, with rotation of the wheel and the ratchet gear being independent of the drive of the plurality of bits;

a ratchet rod pivotable about a pivot axis spaced from the cutting axis and the wheel axis, with the ratchet rod pivotable between an engaging position and a releasing position, with an outer end of the ratchet rod engaged with the ratchet gear when the ratchet rod is in the engaging position preventing rotation of the wheel in a counterclockwise direction but allowing rotation of the wheel in the clockwise direction, with the outer end of the ratchet rod disengaged from the ratchet gear allowing rotation of the wheel in either of the clockwise and counterclockwise directions when the ratchet rod is in the releasing position, with the outer end of the ratchet rod being radially spaced greater from the ratchet gear in the releasing position than in the engaging position; and a safety release movable between a first position and a second position, with the ratchet rod operatively connected to the safety release, with movement of the safety release between the first and second positions causing pivotal movement of the ratchet rod between the engaging position and the releasing position, with the ratchet rod being in the engaging position when the safety release is in the first position, with the ratchet rod being in the releasing position when the safety release is in the second position.

12. The pavement crack router as claimed in claim 11, further comprising, in combination:

a frame axle spaced from the cutting axis in a length direction perpendicular to the wheel axis;

a first beam including an end fixed generally perpendicular to the frame axle, with the wheel axis being generally perpendicular to the first beam;

a driving member connected to the frame axle, with the driving member selectively driving the frame axle to pivot in one of a first direction and a second direction opposite to the first direction; and a switch electrically connected to the driving member, with the switch movable between third and fourth positions to control movement of the frame axle in one of the first and second directions, with the switch in the third position, the frame axle, the first beam, the ratchet gear, and the wheel pivot in the first direction with the frame moving towards the pavement in a vertical direction perpendicular to the length direction and the wheel axis and with the plurality of bits moving towards the pavement and entering the crack in the pavement to a cutting depth, with the switch in the fourth position, the frame axle, the first beam, the ratchet gear, and the wheel pivot in the second direction with the frame and the plurality of bits moving away from the pavement in the vertical direction.

13. The pavement crack router as claimed in claim 12, further comprising, in combination:

a lever including a rear end fixed to the frame axle and a front end, with the driving member including a motor supported by the frame, with a shaft coupled to the front end of the lever and drivable by the motor, with the motor being operable by the switch to drive the frame axle to pivot in the first and second directions via transmission of the shaft, with a potentiometer electrically connected to the motor and adjustable to control an amount of rotation of the motor, wherein the frame traveling in the vertical direction and the cutting depth of the plurality of bits correspond to the amount of rotation of the motor.

14. The pavement crack router as claimed in claim 13, further comprising, in combination:

a jacket fixed to the frame axle, with the ratchet rod pivotably received in the jacket;

a rocker including first and second ends and an intermediate portion between the first and second ends of the rocker, with the intermediate portion of the rocker mounted to the ratchet rod;

a cable including a lower end attached to the first end of the rocker and an upper end coupled to the safety release; and a spring attached to the second end of the rocker, with the spring biasing the ratchet rod to the engaging position.

15. The pavement crack router as claimed in claim 14, further comprising, in combination:

a spring holder including a lower end pivotably mounted to the second end of the rocker and an upper end, with a stop formed on the upper end of the spring holder; and a bracket fixed to the jacket and pivotably receiving the frame axle, with a spring board extending from the bracket, with the spring mounted around the spring holder and between the spring board and the stop.

16. The pavement crack router as claimed in claim 14, further comprising, in combination:

a console fixed to the upper ends of the first and second handle bars;

a handle grip fixed to the console; and a crank including first and second arms, with the first arm pivotably mounted to the console, with the safety release fixed to the second arm of the crank, with the crank and the safety release jointly pivotable between the first and second positions, with the safety release in the second position having a spacing to the handle grip smaller than when in the first position.

17. The pavement crack router as claimed in claim 16, further comprising, in combination:

a second beam including an end fixed generally perpendicular to the frame axle, with the wheel axis being generally perpendicular to the second beam;

another wheel rotatable about the wheel axis and spaced from the wheel in a width direction perpendicular to the length direction, with the frame axle located intermediate the pivot axis and the wheel axis, with the other wheel rested on and movable along the pavement, with the other wheel movably supporting the frame upon the pavement; and another ratchet gear rotatable with the other wheel, with the ratchet rod in the engaging position engaged with the other ratchet gear, with the ratchet rod in the releasing position disengaged from the other ratchet gear.

18. The pavement crack router as claimed in claim 17, further comprising, in combination:

another jacket fixed to the frame axle, with the other jacket aligned with the jacket in the width direction, with the ratchet rod including two arms pivotably received in the jacket and the other jacket, respectively, with each of the two arms having an inner end coaxially coupled together, with each of the two arms further having the outer end releasably engaged with one of the ratchet gear and the other ratchet gear, with the first beam fixed to the jacket, with the second beam fixed to the other jacket.

19. The pavement crack router comprising, in combination:

a frame;

a plurality of bits rotatably supported by the frame about a cutting axis and circumferentially spaced about the cutting axis, with the plurality of bits adapted for opening and cleaning a crack in pavement;

a frame axle spaced from the cutting axis in a length direction;

first and second beams each including an end fixed generally perpendicular to the frame axle, with the frame axle fixed between the first and second beams;

two wheels spaced in a width direction parallel to the frame axle and rotatable about a wheel axis generally perpendicular to the ends of the first and second beams, with the two wheels rested on and movable along the pavement, with the two wheels movably supporting the frame upon the pavement;

a lever including a rear end fixed to the frame axle and a front end, with the frame axle located intermediate the front end of the lever and the wheel axis;

a motor supported by the frame;

a shaft coupled to the front end of the lever and drivable by the motor, with the motor operable to drive the frame axle to pivot in one of a first direction and a second direction opposite to the first direction via transmission of the shaft;

a potentiometer electrically connected to the motor, with the potentiometer adjustable to control an amount of rotation of the motor; and a switch electrically connected to the motor, with the switch movable between first and second positions to control movement of the frame axle in one of the first and second directions, with the switch in the first position, the frame axle, the first and second beams, and the two wheels pivot in the first direction with the frame moving towards the pavement in a vertical direction perpendicular to the length direction and the wheel axis and with the plurality of bits moving towards the pavement and entering the crack in the pavement to a cutting depth, wherein the frame traveling in the vertical direction and the cutting depth of the plurality of bits correspond to the amount of rotation of the motor, with the switch in the second position, the frame axle, the first and second beams, and the two wheels pivot in the second direction with the frame and the plurality of bits moving away from the pavement in the vertical direction.

20. The pavement crack router as claimed in claim 19, further comprising, in combination:

two frame plates fixed to the frame;

first and second handle bars each having a lower end and an upper end;

two inner tubes made of an elastomeric material, with each of the two inner tubes slideably receiving the lower end of one of the first and second handle bars;

two outer tubes, with each of the two outer tubes mounted around one of the inner tubes and fixed to one of the two frame plates; and first and second washers mounted around the lower end of each of the first and second handle bars and sandwiching one of the two inner tubes within one of the two outer tubes, with the upper end of each of the first and second handle bars having a spacing to the frame larger than a spacing of the lower end of each of the first and second handle bars to the frame, with the first and second washers made of an elastomeric material, with each of the two inner tubes being deformable between one of the first and second handle bars and one of the two outer tubes, with the first and second washers allowing movement of the first and second handle bars relative to the two outer tubes and the two frame plates.

* * * * *